US005564790A

United States Patent [19]

Lekavich

[11] Patent Number: 5,564,790

[45] Date of Patent: Oct. 15, 1996

[54] WHEEL FOR IN-LINE SKATES

[76] Inventor: Carl W. Lekavich, P.O. Box 910, Lomita, Calif. 90717

[21] Appl. No.: 375,726

[22] Filed: Jan. 20, 1995

[51] Int. Cl.[6] ..... B60C 25/08

[52] U.S. Cl. ..... 301/5.3; 152/382; 152/394; 152/403

[58] Field of Search ..... 301/5.3, 5.7, 64.7; 152/382, 393, 394, 395, 396, 397, 398, 402, 403; 280/11.22, 11.23

[56] References Cited

U.S. PATENT DOCUMENTS

| | | | |
|---|---|---|---|
| 180,646 | 8/1876 | Saladee . | |
| 687,721 | 12/1901 | Bryant . | |
| 1,983,869 | 12/1934 | Nichol . | |
| 2,271,166 | 1/1942 | Weiss | 301/5.3 X |
| 3,501,162 | 3/1970 | Toone | 301/5.3 X |
| 3,827,792 | 8/1974 | Hollins | 152/403 X |
| 4,666,169 | 5/1987 | Hamill et al. . | |
| 5,308,152 | 5/1994 | Ho . | |
| 5,460,433 | 10/1995 | Hawley | 152/396 X |
| 5,470,086 | 11/1995 | Peterson et al. | 301/5.7 X |

FOREIGN PATENT DOCUMENTS

| | | | |
|---|---|---|---|
| 2178967 | 2/1987 | United Kingdom | 280/11.23 |

*Primary Examiner*—Russell D. Stormer
*Attorney, Agent, or Firm*—Richard C. Litman

[57] ABSTRACT

An improvement to an in-line skate wheel assembly rotatably mounted to a mounting frame axle juxtaposed a skate boot which lends to firmer and less degrading tire support and facilitates ready adaptation of different kinds of tires to suit varying skating activities.

15 Claims, 3 Drawing Sheets

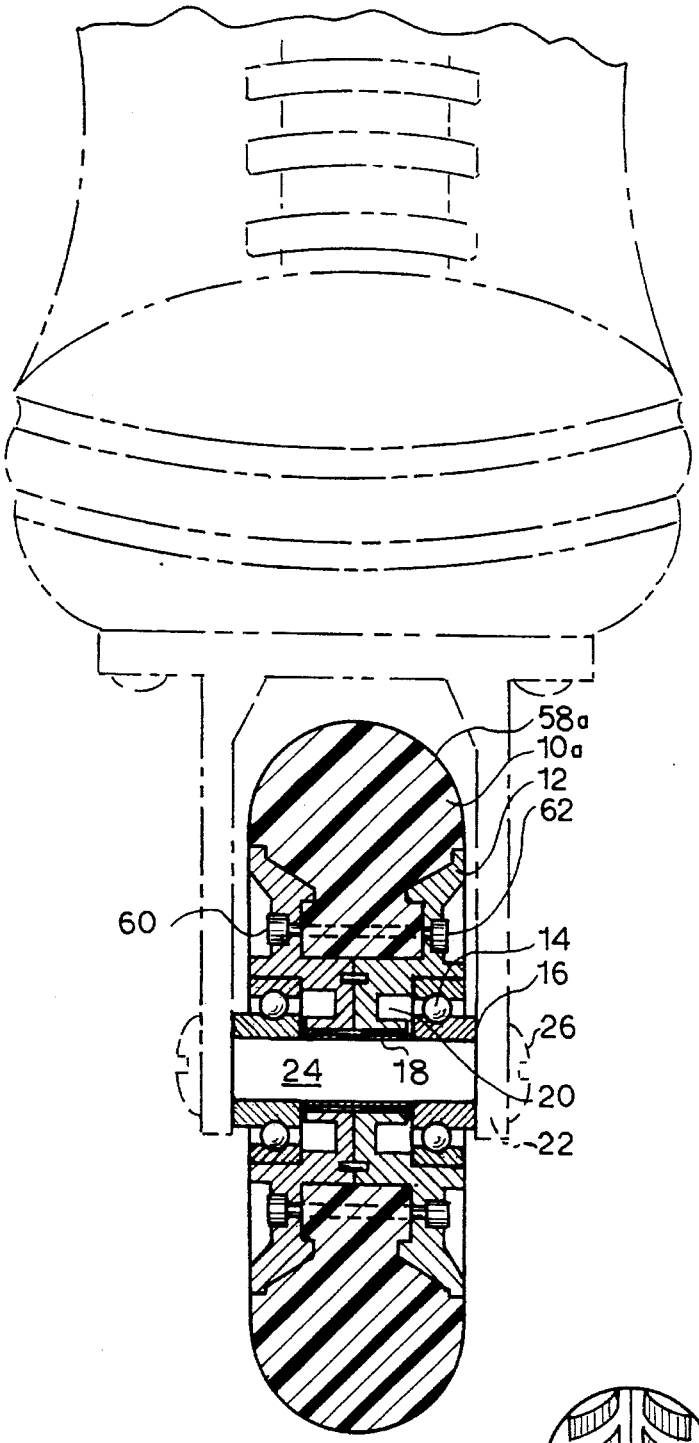
FIG. 1
FIG. 2A
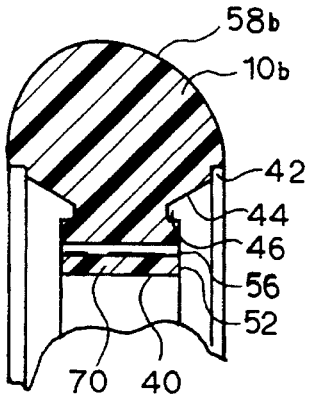
FIG. 2B
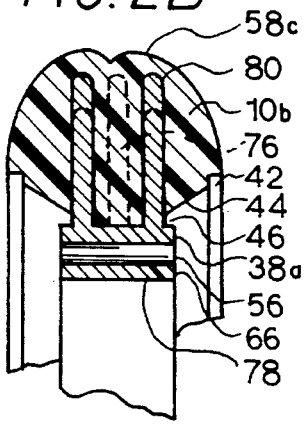
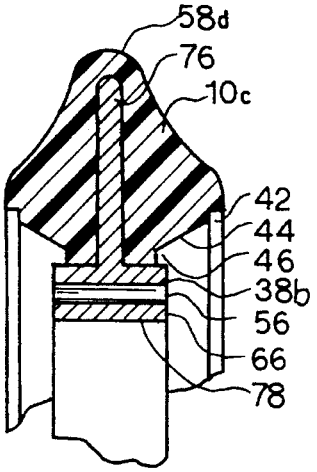
FIG. 2C
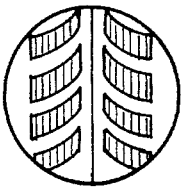
FIG. 6

FIG. 5A
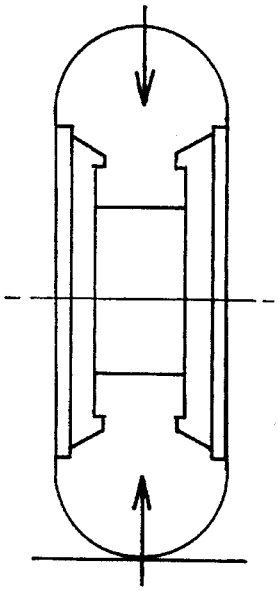
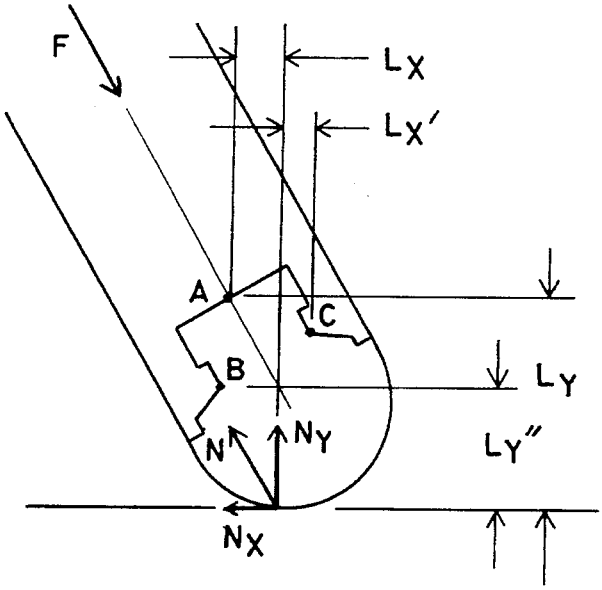
FIG. 5B
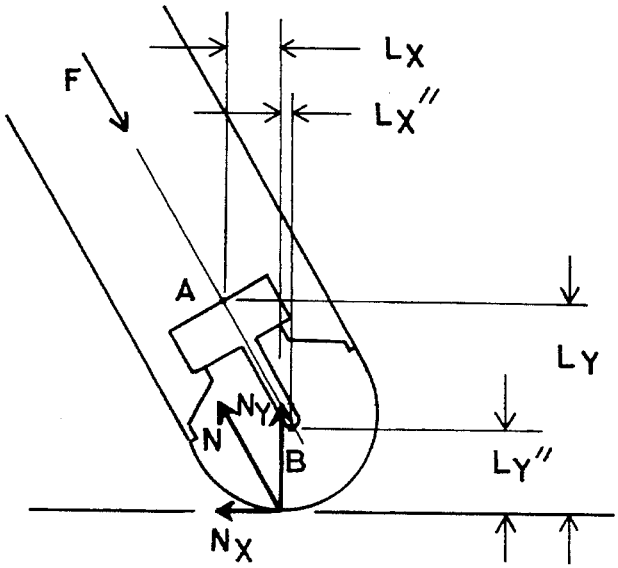
FIG. 5C

WHEEL FOR IN-LINE SKATES

BACKGROUND OF THE INVENTION

1. Field of the Invention

This invention relates to an improvement for in-line or conventional roller skate wheels, more particularly structures which improve tire stiffness, permit ready tire changes to accommodate different skating conditions, prolong tire life and reduce complexity.

2. Description of the Prior Art

Conventional roller skating has enjoyed considerable popularity for decades if not centuries. Although in-line roller skates are not novel, interest in them did not eclipse that in conventional skates until technological advances gave skaters greater capability on them in the last decade.

A conventional wheel used for in-line skating consists of a thermoset urethane tire molded on or about a single or split flanged hub. Urethane is inherently soft and malleable. When a skater turns or exerts force lateral to the rotational plane of the tire, the tire bends. In addition to the heat caused by friction which the tire experiences, repeated bending causes a weakening of the tire material and eventually leads to failure. From a performance aspect; skaters not only lose speed due to energy dissipation, but also the ability to precisely control the their movement. Prior inventors have addressed these vexing problems, but none have resolved them as fully as the present invention.

In-line skating has evolved into many different performance specialties, not unlike those of ice skating. Some fast-evolving areas include: hockey, speed skating, trick skating and touring. Each specialty area imposes different demands on skaters' tires which are better met by different tire designs. Additionally, many skaters may perform better with tread designs, not unlike on automobile tires, which are more suited to inclement weather or other conditions. Because skaters should not be resigned to only one type of activity or weather condition, skaters should be able rapidly to fit their skates with tires appropriate for each type of activity or circumstance in which they skate. Prior inventions do not address this problem at all.

U.S. Pat. No. 180,646 issued Aug. 1, 1876 to C. W. Saladee describes a wheel assembly which comprises dual hubs which capture and compresses the tire, and a bearing set. Saladee's invention does not include a tire stiffened with a rib, or a hub structure designed to positively restrict lateral displacement of the tire under great lateral stress. Saladee's wheel assembly also includes only one set of bearings whereas the instant invention has two to better withstand these aforementioned tremendous lateral forces.

U.S. Pat. No. 687,721 issued Dec. 3, 1901 to T. W. Bryant describes a wheel assembly which comprises dual hubs which capture a simple toroidal tire and which form the races for two sets of bearings. First, Bryant's design does not take advantage of the speed enhancing properties of precision bearings which are included in the instant invention. Second, Bryant's invention involves spacers between the hubs which have been eliminated in the instant invention. Finally, Bryant's tire is not stiffened by a rib or restrained by a hub flange which deters tire slippage due to lateral forces.

U.S. Pat. No. 1,983,869 issued Dec. 11, 1934 to R. M. Nichol describes a skate wheel assembly which comprises dual hubs which capture a toroidal tire and which ride on the outer surface of a singular bearing package mounted on an axle. Nichol's design suffers some of the same difficulties as the above inventions and, due to the high walls formed on both outside edges of the tire, lacks the ability to accommodate severe turns which are commonplace to modern in-line skating.

U.S. Pat. No. 4,666,169 issued May 19, 1987 to S. Hamill et al. describes a wheel assembly comprising a tire molded onto a single hub and encapsulating a cross-shaped rib. Hamill's invention fails to incorporate the tire with a hub having flanges hub oblique to the wheel assembly's rotational axis which would support the tire during maneuvers when the great force is applied to the tire at non-perpendicular angles to the axle. The present invention provides this support, thereby improving the life and stability of the tire. The rib Hamill discloses also includes circumferential protuberances. The present invention has no circumferential protuberances, rather radially diverged bores through which tire material may be cast thereby affording even greater stability. Hamill's rib is further limited to being incorporated within a singular hub, rather than being part of the tire both of which being sandwiched by dual, symmetrical hubs.

The present invention provides significant advances over Hamill's invention: First, the user may employ different tire/rib assemblies with the same hubs and bearing assemblies; the user will not be forced to purchase multiple bearing and hub sets with each tire selection, rather only the tire/rib assemblies the user needs. Second, although Hamill's invention is purposed at stabilizing the tire, it is shown extending only part way through the tire. Hamill's tire will be less axially deformable than without a rib, but not nearly as stiff as in the present invention which extends the rib nearly to the tread. More importantly, Hamill's invention fails to address radial deformation of the tire while skating. Radial deformation operates to dissipate rolling momentum and slows a skater down or reduces the skaters' gliding ability. The present invention provides a rib extending through practically the entire length of the tire leaving little material between the rib and the skating surface, thereby allowing little deformation and improving performance.

U.S. Pat. No. 5,308,152 issued May 3, 1994 to D. Ho describes two types of wheel assemblies which both comprise dual hubs which capture the tire along with a singular bearing package: (1) in which the tire is shaped to accommodate a stepped configuration matching the hub; and (2) in which the tire encapsulates a radial, tangential, t-shaped resilient member along the inner circumference of the tire. Ho's hub design fails to permit hub interchangeability as the instant invention does by incorporating alternatingly tapped and untapped holes for accommodating the head or threaded portion of the fastener used to hold the assembly together. Ho's stepped-hub design also does not take advantage of a smooth interface between tire and hub which the instant invention utilizes so that when skaters make severe turns, the forces against the side of the tire are normal to a smooth hub wall holding the tire in place; Ho's stepped configuration introduces stress nodes which may cause premature failure of the tire. Finally, Ho's t-shaped encapsulated member may serve to hold the tire in place, but does not provide tire outer edge stiffness that the instant invention provides which better resists the lateral forces imposed on the tire and permits skaters to employ thinner tires with less resistance.

None of the above inventions and patents, taken either singly or in combination, is seen to describe the instant invention as claimed.

SUMMARY OF THE INVENTION

The present invention is an improvement to in-line skate wheel assembly rotatably mounted to a mounting frame axle juxtaposed a skate boot. The present invention improves tire durability and provides skaters with a means to control their movements with more accuracy as well as increase their speed and reduce rolling resistance they may encounter by improving the hub structure which lends to firmer and less degrading tire support. This hub structure also reduces manufacturing complexity which improves cost efficiency by providing for interchangeability.

Because in-line skating has evolved into many different performance specialties, not unlike those of ice skating, the present invention improves skaters' ability to adapt the type of tires they use to the kind of activity in which they engage by facilitating ready changeability.

In consideration of the above, an object of the invention is to improve structural integrity of a skate tire, thus reducing deterioration and improving positional sensitivity, by providing: (1) within the annular groove of a hub a smooth annular surface oblique to the rotational plane of the hub which supports a complementary tire surface; (2) within this hub groove, an annular tooth which engages a complementary annular groove on the tire; and/or (3) at least one rigid rib within the tire.

Another object of the invention is to provide skaters the ability to readily select and install tires which are appropriate for specific activities.

An additional object of the invention is to provide for interchangeability of each half of a two-piece hub.

A further object of the invention is to reduce heat build up in a skate which degrades the tires as well as bearings by providing a heat exchanging structure within the hub.

It is yet another object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 is an environmental front view of an embodiment of the invention.

FIG. 2A is a section view of a tire having an off-set parabolic profiled tread used to carry out an embodiment of the invention.

FIG. 2B is a section view of another tire having a double-domed, helically grooved tread profile which is fixed to a twin-ribbed mounting ring (a tri-ribbed embodiment is shown in dashed lines) used to carry out another embodiment of the invention.

FIG. 2C is a section view of yet another tire having a wedge-shaped tread profile which is fixed to a ribbed mounting ring used to carry out yet another embodiment of the invention.

FIG. 5A is a diagrammatic view of the forces involved in a wheel assembly while skating.

FIG. 5B is a diagrammatic view of the forces involved in a wheel assembly while skating about a turn.

FIG. 5C is a diagrammatic view of the forces involved in a wheel assembly including a ribbed mounting ring while skating about a turn.

FIG. 6 is a bottom view of the footprint of the double-domed tire shown in section view in FIG. 2B.

Similar reference characters denote corresponding features consistently throughout the attached drawings.

DETAILED DESCRIPTION OF THE PREFERRED EMBODIMENTS

Figure 3:
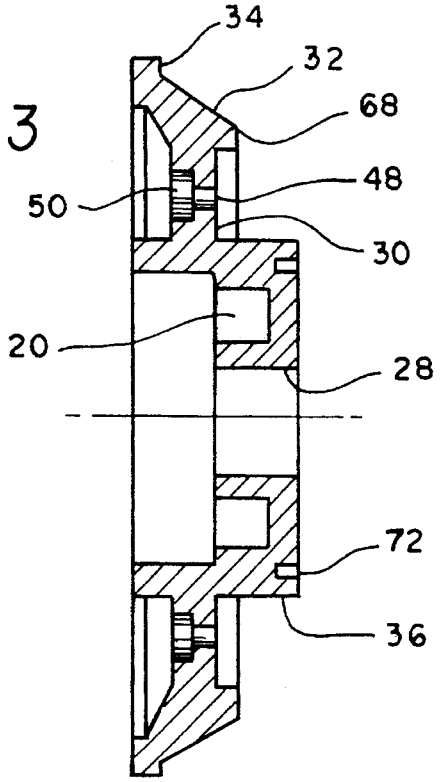
FIG. 3 is a section view of a hub used to carry out an embodiment of the invention.

FIG. 1 is an environmental front view of an embodiment of the invention showing a one-piece tire 10*a* which, as with any other tire embodiments shown in the attached FIGS., may be formed from conventional thermoplastic elastomers, thermoplastic polyester elastomers (e.g. Hytrel® by DuPont), thermosetting elastomers, natural or synthetic rubber elastomers (e.g. Katron® by Shell), polyurethane elastomers or the like. The tire 10*a* is retained by symmetrical hubs 12, which may be constructed of any rigid, shock-resistant material. The hubs 12 are held together to firmly clamp the tire 10*a* with a plurality of threaded fasteners 60 which pass through any number of holes 48 bored through the hub 12 and holes 52 through the tire 10*a* and engage a like number of threaded bushings 62.

Referring to FIGS. 2B and 2C, fasteners 60 would pass through holes 56 bored through mounting rings 38*a* or 38*b*. Referring to FIG. 3, counter bores 50 in series with the aforementioned hub holes 48 accommodate either threaded fastener heads or bushings 62, thus permitting hub 12 interchangeability; identical hubs 12 may be implemented rather than necessitating threaded holes. This interchangeability feature also reduces manufacturing costs by eliminating the need for different dies and adds simplicity to the design for assembly ease. Alternatively, the hubs 12 may have threaded holes 56 (threading not shown) to receive threaded fasteners 60.

The hubs 12 also include annular surfaces 30 which mate with annular surfaces 52 on the tire 10*a* or annular surfaces 66 on the mounting rings 38*a* or 38*b*. The area captured by the surface described, on a one-piece tire 10*a*, by annular tooth 68 annular surface 30 cylindrical surface 36 and the symmetrically disposed surfaces which mate with complementary tire surfaces described by annular notch 46, annular surface 52 and cylindrical surface 40, shall be referred to hereinafter as the tire lock 70.

Figure 4:
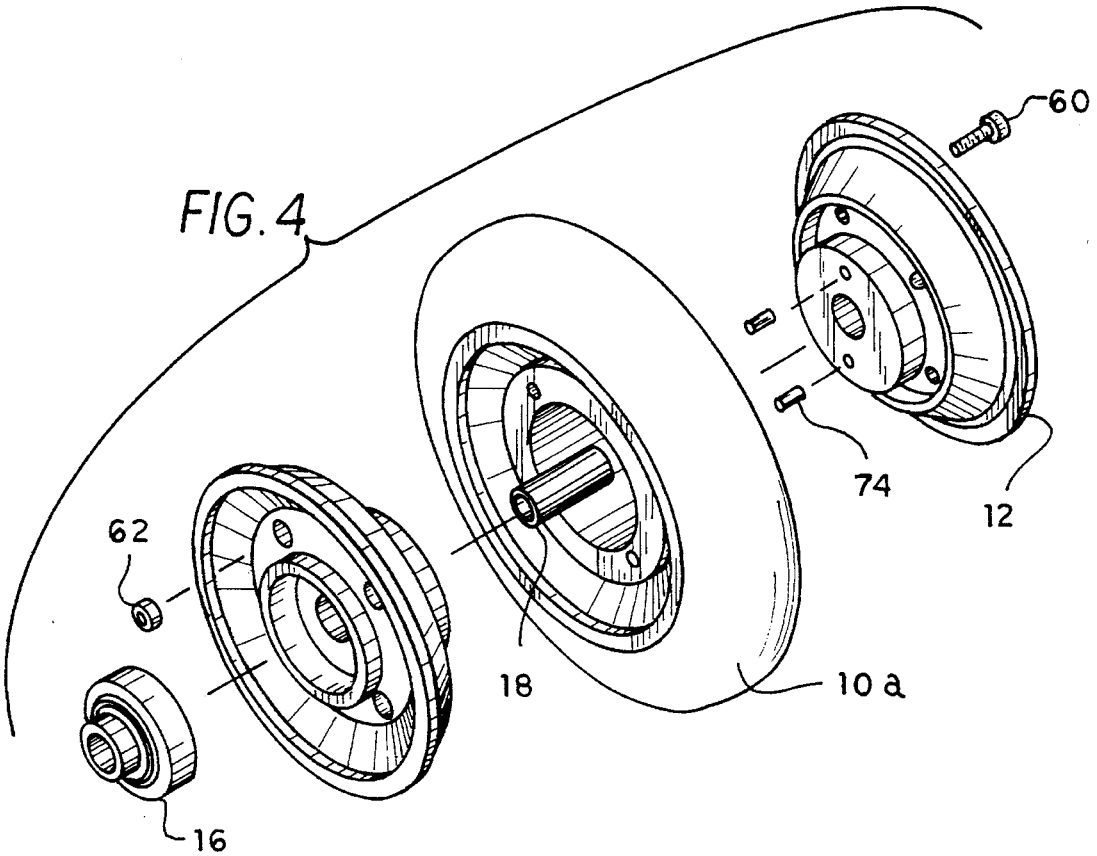
FIG. 4 is an exploded view of an embodiment of the invention.

In cases where two-piece tires 10*b* or 10*c* are incorporated in the invention, the surfaces within the tire lock 70 include the notch 46, annular surface 66 and cylindrical surface 78. Referring to FIG. 4, the hubs 12 also include a hole or slot 72 for alignment pins 74 to prevent the hubs 12 from rotating relative to each other about the central axis, which might introduce shear stresses to the fasteners 60 or render them difficult to remove.

The hubs 12 each house precision bearings 14 which have shoulders 16 on the outer edges of the inner races which mate with the mounting frame 22. The inside edge of the inner races are separated by bearing sleeves 18. Since bearing wear is greatly heightened when in service at high temperatures, the hubs 12 include a plasma groove 20 to retain heat reduction materials or otherwise aid in cooling. This feature should greatly increase the life of the bearings 14. The bearings 14 and bearing sleeve 18 frictionally engage an axle shaft 24 which passes through hub hole 28 and which is held between the flanges of the mounting frame 22 by an axle shaft lock nut 26.

Referring to FIG. 5A, as a skater glides on tires having central axes parallel to the skating surface, the equal and opposite normal forces create largely compressive stresses and little bending or shear stresses in the tires 10*a* within the hub groove.

Referring to FIG. 5B, when skaters push off or make turns, however, much greater non-parallel forces act on the tire which significantly increase these bending and shear stresses. The non-parallel normal forces may be categorized into x- and y-components. The x-component of normal force is inclined to drive the tire 10*a* off the hub 12 toward the turn focus or foci. First, the hub flange 34 which mates with tire annular surface 42 deters the tire annular surface 44 from sliding off the hub annular surface Since the annular surface 32 is effectively normal to the x-component, the tire 10*a* experiences largely compressive rather than shear or bending forces. The prior art, specifically D. Ho's invention, includes a stepped surface which actually promotes shear and bending.

The tire lock 70 introduces structure to the wheel assembly which combats a number of stress loading problems in the tire 10*c* associated with skating. First, the moment created by the x-component of normal force which would ordinarily act over the moment arm $L_y$ is reduced because it acts over an effective moment arm $L_{y'}$. The reduced moment reduces the bending stresses which the tire 10*a* would ordinarily experience. Second, since the tire 10*a* is captured and prevented from sliding or deforming from its design position, the tire 10*a* should experience far less of the cyclic loading and unloading effects which it otherwise would. Finally, the tire lock 70 also resists the tendency of the moment created to pull the tire material away from the second cylindrical surface 36. This pulling away effect is discussed further below with respect to inclusion of mounting rings 38*a* and 38*b*.

The y-component of the normal force is inclined to drive the tire 10*a* off the hub 12 away from the turn focus or foci. As above, the hub flange 34 deters the tire 10*a* from sliding off the annular surface 32 which is normal to the y-component thus creating compressive rather than shear and bending stresses. Again, the tire lock 70 reduces bending stresses introduced by the moment created by the y-component of normal force because is does not act over the moment arm $L_x$, but an effective moment arm $L_{x'}$. Also as above, cyclical loading is reduced as well as the tendency of the material to pull away from the cylindrical surface 36.

This pulling away from the cylindrical surface 36 is reduced even further by introduction of a rigid mounting rings 38*a* and 38*b*. Referring to FIG. 2B, a tire 10*b* is mounted to a mounting ring 38*a*. Because the mounting ring 38*a* is stiff, the junction between the tire 10*b* and the mounting ring 38*a* will resist bowing or material flow into the direction which the normal forces compel, unlike when the tire is formed entirely from elastomeric materials as discussed above. This increased stiffness will further decrease the shear and bending stresses created within the tire 10*b*.

FIG. 2C is a section view of the preferred embodiment of the tire 10*c* mounted to ribbed mounting ring 38*b*. Tire integrity is significantly improved by the addition of the t-shaped annular rib 76 which practically eliminates all bending and shear forces in the tire material because it is quickly transmitted to the rib 76 which is able to withstand the forces better. Referring to FIG. 5C, the moment created by the x-component of normal force which would ordinarily act over the moment arm $L_y$ is reduced because it acts over $L_{y''}$. The moment created by the y-component of normal force which would ordinarily act over the moment arm $L_x$ is reduced because it acts over $L_{x''}$. As discussed above, reduction of the moments and the concomitant shear and bending forces greatly enhances the life of the tire 10*c*.

Another major advantage associated with introduction of a rigid rib 76 within the tire is the ability to make thinner tires 58*d*. Referring to FIG. 2C, it can be seen that less material is required to support the skater since most of the weight and or forces associated with skating are withstood by the rib 76 rather than the large mass of the elastomeric material described above which would otherwise be required to sustain similar loading conditions. Less material translates into less rotational inertia to resist motion and less rolling friction from material in contact with the skating surface. Skaters will be able to skate longer and faster with a thin, ribbed tire 58*d* than tires described in the prior art.

Referring to FIG. 2B, multiple ribs may lend even greater support, tire profiles permitting, by further reducing moment arms created while skating. In FIG. 2B, a double-domed tire profile is shown having a twin-ribbed mounting ring 38*a* to enforce the lobes of the profile. Although not specifically intended for the double-dome embodiment, a third rib 76 may be added, perhaps with the outer two ribs 80 shortened.

As mentioned above, skaters participate in various activities which may require different kinds of tread profiles. The standard parabolically-shaped tire 58*a* may be perfectly suited for all-purpose skating. The above "thin tire" 58*d* is ideally suited for long distance skating because less tread is on the skating surface, thus creating less friction to slow the skater down. During inclement conditions, referring to FIGS. 2B and 6, skaters may prefer to install a double domed, helically grooved tire tread 58*c* which channels fluid away from the footprint of the tire 58*c*. For hockey players, who make sudden abusive stops which tend to wear the outer edges of their skates faster than the inner edges, the present invention includes (referring to FIG. 2A) an off-set parabolically shaped tire 58*b*, the off-set being made toward the outside of the skate 64. Providing more material to the outside edge of the tire 58*b* should significantly improve the life span of hockey tires 58*b*.

The present invention is not intended to be limited to the sole embodiment described above, but to encompass any and all embodiments within the scope of the following claims.

I claim:

1. In a wheel assembly rotatably mounted to an axle of a mounting frame, an improvement comprising:

two symmetrical hubs each including a first central hole having a central axis perpendicular to a rotational plane of said hub, said hubs being engageable with each other and forming a radial groove when engaged; and a tire including a second central hole with a central axis collinear with said first central hole central axis and perpendicular to a rotational plane of said tire, said tire disposed within said radial groove of said hubs;

said hubs each including a first cylindrical surface, a first, second and third annular surface and an annular tooth disposed within said annular groove of said hub, said first and third annular surfaces parallel to said rotational plane of said hub, said third annular surface disposed farther than said first annular surface from said rotational plane of said hub, said second annular surface oblique to said rotational plane of said hub and interposed said first and third annular surfaces and said annular tooth interposed said first and second annular surfaces;

said tire including a cylindrical surface contacting said first cylindrical surface of said hubs, a fourth, fifth and sixth annular surface and a first annular notch complementarily contacting said first, second and third annular surfaces and annular tooth of said hub, respectively, and a seventh, eighth and ninth annular surface and a second annular notch symmetrically disposed about said rotational plane of said tire and similarly complementarily contacting said symmetrically engaged hub;

said tire including a plurality of holes radially diverged about and between said fourth and seventh annular surfaces of said tire, each hole having central axes parallel to said second central hole axis of said tire;

said hubs each including a like number of holes as disposed and at said radius of divergence about and between said fourth and seventh annular surfaces of said tire, each hole having a central axis parallel to said first central hole of said hub;

said hubs each including a second cylindrical surface which extends through said hub sufficient to accommodate a bearing assembly.

2. In a wheel assembly rotatably mounted to an axle of a mounting frame, the improvement according to claim 1 wherein said hubs each include a third annular notch interposed said second cylindrical surface and said first central hole of said hubs, and dimensioned and configured to retain sufficient heat reduction material to maximize heat transfer from said bearing assembly.

3. In a wheel assembly rotatably mounted to an axle of a mounting frame, the improvement according to claim 1 wherein said symmetrical hubs each include a number of bores corresponding to said number of holes disposed within said hubs, said bores having axes collinear with said radially diverged holes in said hubs, and further being dimensioned and configured to accommodate one of bushings and fastener heads.

4. In a wheel assembly rotatably mounted to an axle of a mounting frame, the improvement according to claim 1 wherein said tread of said tire has a profile constructed in an off-set, parabolic shape disposed about said rotational plane of said tire.

5. In a wheel assembly rotatably mounted to an axle of a mounting frame, the improvement according to claim 1 wherein said tread of said tire has a profile constructed in a double-domed shape having helical grooves symmetrically disposed about said rotational plane of said tire to channel fluids away from a footprint centerline of said tire parallel to said rotational plane of said tire.

6. In a wheel assembly rotatably mounted to an axle of a mounting frame, the improvement according to claim 1 wherein said tread of said tire has a profile constructed in a wedge shape disposed about said rotational plane of said tire.

7. In a wheel assembly rotatably mounted to an axle of a mounting frame, the improvement according to claim 1 wherein said hub includes at least one hole which receives an alignment pin interposed a like number of holes in said hub symmetrically disposed with respect to said rotational plane of said hub.

8. In a wheel assembly rotatably mounted to an axle of a mounting frame, an improvement comprising:

two symmetrical hubs each including a first central hole having a central axis perpendicular to a rotational plane of said hub, said hubs being engageable with each other and forming a radial groove when engaged;

a mounting ring including a second central hole having a central axis collinear with said first central hole central axis and perpendicular to a rotational plane of said mounting ring, said mounting ring disposed within said radial groove of said hubs; and a tire having a rotational plane parallel to said rotational plane of said hub fixed about said mounting ring and disposed within said radial groove of said hubs;

said hubs each including a first cylindrical surface, a first, second and third annular surface and an annular tooth disposed within said annular groove of said hub, said first and third annular surfaces parallel to said rotational plane of said hub, said third annular surface disposed farther than said first annular surface from said rotational plane of said hub, said second annular surface oblique to said rotational plane of said hub and interposed said first and third annular surfaces and said annular tooth interposed said first and second annular surfaces;

said mounting ring including a cylindrical surface contacting said first cylindrical surface of said hubs and a fourth annular surface complementarily contacting said first annular surface of said hub and a seventh annular surface symmetrically disposed about said rotational plane of said mounting ring and similarly complementarily contacting said symmetrically engaged hub;

said tire including a fifth and sixth annular surface and a first annular notch complementarily contacting said second and third annular surface and annular tooth of said hub, respectively, and an eighth and ninth annular surface and a second annular notch symmetrically disposed about said rotational plane of said tire and similarly complementarily contacting said symmetrically engaged hub;

said mounting ring including a plurality of holes radially diverged about and between said fourth and seventh annular surfaces of said mounting ring, each hole having a central axis parallel to said second central hole axis of said mounting ring;

said hubs each including a like number of holes as disposed and at said radius of divergence about and between said fourth and seventh annular surfaces of said mounting ring, each hole having a central axis parallel to said first central hole of said hubs;

said hubs each including a second cylindrical surface which extends through said hub sufficient to accommodate a bearing assembly.

9. In a wheel assembly rotatably mounted to an axle of a mounting frame, the improvement according to claim 8 wherein said mounting ring includes at least one radial rib extending tangentially from a top surface of said mounting ring.

10. In a wheel assembly rotatably mounted to an axle of a mounting frame, the improvement according to claim 8 wherein said hubs each include a third annular notch interposed said second cylindrical surface and said first central hole of said hubs, and dimensioned and configured to retain sufficient heat reduction material to maximize heat transfer from said bearing assembly.

11. In a wheel assembly rotatably mounted to an axle of a mounting frame, the improvement according to claim 8 wherein said symmetrical hubs each include a number of bores corresponding to said number of holes disposed within said hubs, said bores having axes collinear with said radially diverged holes in said hubs, and further being dimensioned and configured to accommodate one of bushings and fastener heads.

12. In a wheel assembly rotatably mounted to an axle of a mounting frame, the improvement according to claim 8 wherein said tread of said tire has a profile constructed in an off-set, parabolic shape disposed about said rotational plane of said tire.

13. In a wheel assembly rotatably mounted to an axle of a mounting frame, the improvement according to claim 8 wherein said tread of said tire has a profile constructed in a double-domed shape and helical grooves symmetrically disposed about said rotational plane of said tire to channel fluids away from a footprint centerline of said tire parallel to said rotational plane of said tire.

14. In a wheel assembly rotatably mounted to an axle of a mounting frame, the improvement according to claim 8 wherein said tread of said tire has a profile constructed in a wedge shape disposed about said rotational plane of said tire.

15. In a wheel assembly rotatably mounted to an axle of a mounting frame, the improvement according to claim 8 wherein said hub includes at least one hole or slot which receives an alignment pin interposed a like number of holes or slots in said hub symmetrically disposed with respect to said rotational plane of said hub.

* * * * *